US008960372B2

(12) United States Patent
Heath et al.

(10) Patent No.: US 8,960,372 B2
(45) Date of Patent: Feb. 24, 2015

(54) ELEVATOR CAR DOOR INTERLOCK

(75) Inventors: Ernest Heath, Olive Branch, MS (US); Anthony Hamlett, Bartlett, TN (US); Sang Choi, Lakeland, TN (US); Brian Chapman, Memphis, TN (US); Sang Lee, Cordova, TN (US); Chet Willoughby, Savannah, TN (US); Jie Xu, Memphis, TN (US); Houston Patrick, Lake Cormorant, MS (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 173 days.

(21) Appl. No.: 13/178,142

(22) Filed: Jul. 7, 2011

(65) Prior Publication Data

US 2012/0006629 A1 Jan. 12, 2012

Related U.S. Application Data

(60) Provisional application No. 61/362,441, filed on Jul. 8, 2010.

(51) Int. Cl.

| | |
|---|---|
| ***B66B 1/26*** | (2006.01) |
| ***B66B 13/26*** | (2006.01) |
| ***E05C 7/06*** | (2006.01) |
| ***E06B 3/00*** | (2006.01) |

(Continued)

(52) U.S. Cl.

CPC ..... *B66B 13/185* (2013.01)
USPC ..... 187/301; 187/317; 49/120; 49/506; 70/100; 70/280

(58) Field of Classification Search

USPC ..... 187/301, 316, 317, 331, 335; 49/26, 49/118, 120, 370, 506; 70/96–100, 278.1, 70/280–282; 340/686.1, 686.2

See application file for complete search history.

(56) References Cited

U.S. PATENT DOCUMENTS

| | | | | |
|---|---|---|---|---|
| 1,822,152 | A * | 9/1931 | Kinnard et al. | 187/317 |
| 1,959,042 | A * | 5/1934 | Staley | 187/315 |

(Continued)

FOREIGN PATENT DOCUMENTS

| | | |
|---|---|---|
| CA | 2478078 | 10/2003 |
| WO | WO/2006/097997 | 9/2006 |

OTHER PUBLICATIONS

"Residential Elevator Products 2010, " Porta Inc., http://www.emiporta.com/Porta%20Catalog.pdf, printed Nov. 22, 2011, pp. 1-30.

(Continued)

*Primary Examiner* — William E Dondero
*Assistant Examiner* — Minh Truong
(74) *Attorney, Agent, or Firm* — Frost Brown Todd LLC

(57) ABSTRACT

An apparatus for use with an elevator car is operable to selectively lock an elevator car door. The apparatus verifies that the elevator car door is closed, locks the elevator car door, and verifies that a lock is engaged. Once conditions are met, the apparatus signals an elevator controller that the elevator car can move through a hoistway. The apparatus further ensures that passengers can safely disembark from the elevator car by detecting the position of the elevator car relative to a designated landing zone within the hoistway, and confirming the elevator car is stopped at a landing zone prior to disengaging the lock. The apparatus thus ensures that the elevator car door remains closed while the elevator car is in motion or between landing zones.

17 Claims, 10 Drawing Sheets

(51) Int. Cl.

| | |
|---|---|
| ***E05B 65/08*** | (2006.01) |
| ***E05B 47/00*** | (2006.01) |
| ***B66B 13/18*** | (2006.01) |

(56) References Cited

U.S. PATENT DOCUMENTS

| | | | | |
|---|---|---|---|---|
| 2,003,399 | A * | 6/1935 | Tamsitt | 187/319 |
| 4,436,184 | A * | 3/1984 | Dorman et al. | 187/331 |
| 4,483,420 | A * | 11/1984 | Byrne | 187/280 |
| 4,529,065 | A * | 7/1985 | Kraft | 187/314 |
| 5,454,447 | A * | 10/1995 | Kulak et al. | 187/331 |
| 5,655,627 | A | 8/1997 | Horne et al. | |
| 5,669,465 | A * | 9/1997 | Kulak et al. | 187/331 |
| 5,896,953 | A | 4/1999 | Horne et al. | |
| 6,006,866 | A | 12/1999 | Horne et al. | |
| 6,659,514 | B2 * | 12/2003 | Bass | 292/122 |
| 7,097,001 | B2 * | 8/2006 | Martin | 187/316 |
| 7,140,470 | B2 | 11/2006 | Azpitarte | |
| 7,178,638 | B2 * | 2/2007 | Fujita et al. | 187/333 |
| 2005/0217802 | A1 * | 10/2005 | Goodman et al. | 160/84.02 |

OTHER PUBLICATIONS

"ElectroLock Electronic Door Restrictor," Electrodyn Systems, Ltd. (2011) http://www.electrodyn.com/ElectroLock.html, printed Nov. 22, 2011, p. 1.

"ElectroLock Door Restrictor F.A.Q.," Electrodyn Systems, Ltd. (2011) http://www.electrodyn.com/ElectroLock/ElectroLock%20FAQ.pdf, printed Nov. 22, 2011, pp. 1-3.

"Installation and Service Manual Hatch Latch™," Adams Elevator Equipment Co. (Feb. 14, 2006) pp. 1-4.

"Product Bulletin NEB Installation Management," Kone Inc. (2006) pp. 1-5.

"UNITEC Door Restrictors," UNITEC Elevator and Escalator Systems and Parts (1999) p. 1.

* cited by examiner

ELEVATOR CAR DOOR INTERLOCK

PRIORITY

This application claims priority to U.S. Provisional Application Ser. No. 61/362,441, filed Jul. 8, 2010, entitled "Elevator Car Door Interlock," the disclosure of which is incorporated by reference herein.

BACKGROUND

Some exemplary elevator systems comprise elevator cars traveling through a hoistway. In such systems, the elevator cars comprise doors and the hoistway comprises doors at various landing zones. In operation, while moving through the hoistway, the elevator car doors remain closed until stopping at a landing zone where the elevator car doors and the hoistway doors can align and open, thus allowing passengers to enter and exit. If the elevator system malfunctions and stops between floors, a passenger in the elevator car can attempt to open the elevator car door. In another situation, the elevator system could malfunction and unlock the elevator car door as the elevator car is moving, allowing a passenger to open the elevator car door. Each of these situations risks injury to the passenger. Thus, in some instances it is desirable that the elevator car door remain closed when moving between floors and stay closed if the elevator stops outside a landing zone so that passengers cannot open the elevator car door.

While a variety of elevator car door locking systems have been made and used, it is believed that no one prior to the inventors has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings like reference numerals identify the same elements.

Figure 1:
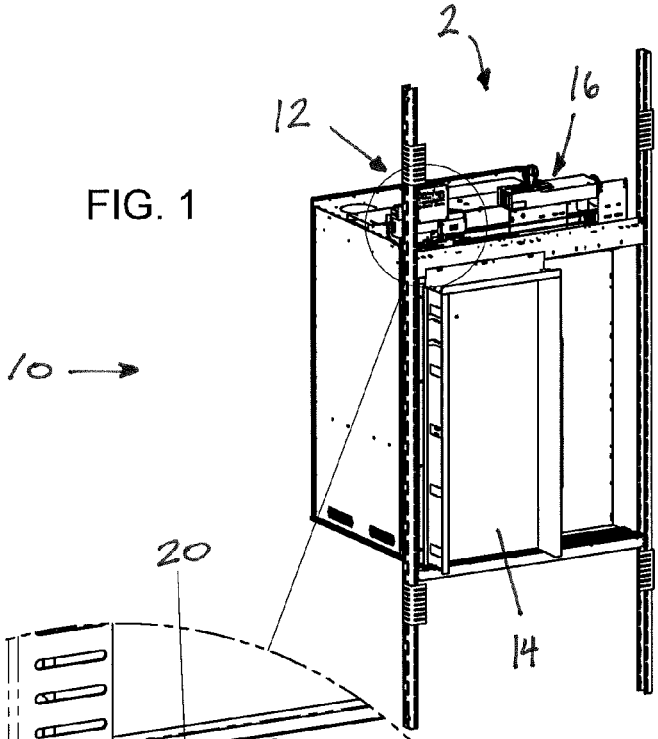
FIG. 1 depicts a perspective view of an exemplary elevator car incorporating an exemplary car door interlock.

The drawings are not intended to be limiting in any way, and it is contemplated that different versions may be carried out in other ways, including those not necessarily depicted in the drawings. The accompanying drawings illustrate several aspects of the present invention, and with the description serve to explain the principles of the invention. The present invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

FIG. 1 illustrates an exemplary elevator car (10) incorporating an exemplary a car door interlock (12), where elevator car (10) travels within a hoistway (2). Elevator car (10) comprises car door interlock (12), elevator car door (14), and door operator (16). Hoistway (2) has one or more hoistway doors (not shown) located at various landing zones along hoistway (2). The landing zones are areas within hoistway (2) where elevator car door (14) can align with the hoistway door such that elevator car door (14) and the hoistway door can safely open and close to allow passengers to enter or exit elevator car (10).

In the illustrated version, elevator car (10) comprises a single elevator car door (14) connected to door operator (16). Door operator (16) is operable to open and close elevator door (14) by sliding elevator door (14) in first and second directions using conventional means known to those of ordinary skill in the art. In other versions, elevator car (10) comprises multiple elevator car doors (14). By way of example only, in some versions elevator car (10) comprises two doors where the doors have a center opening. Still in other versions elevator car (10) comprises two or more speed doors.

In the illustrated version, car door interlock (12) is securely attached to portions of elevator car (10) near the top of elevator car (10) above elevator car door (14). In other versions, car door interlock (12) is installed in other positions on elevator car (10). By way of example only, in some versions car door interlock (12) is securely attached to portions of elevator car (10) near the bottom of elevator car (10) below elevator car door (14). Still in other versions, car door interlock (12) can be positioned anywhere on elevator car (10) where car door interlock (12) can contact elevator car door (14), either directly or through an intervening structure, to lock and unlock elevator car door (14) as will be discussed further below.

Figure 2:
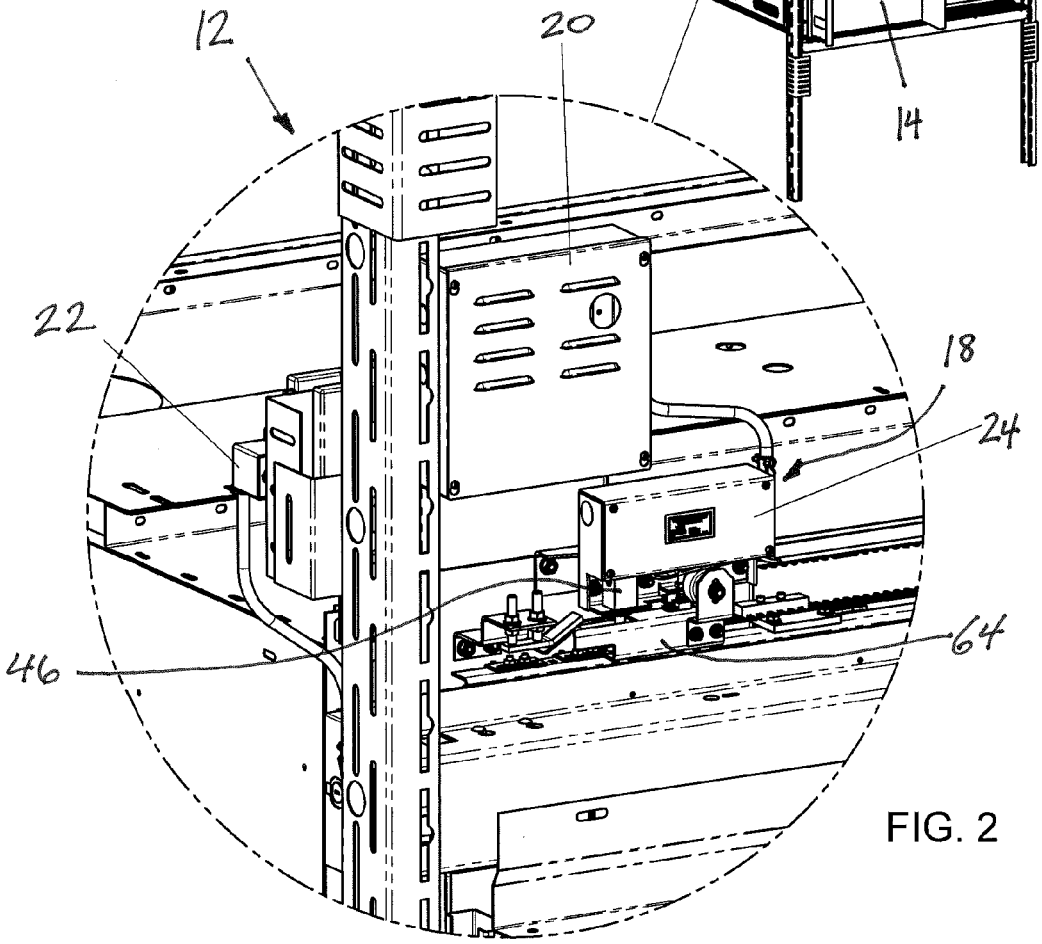
FIG. 2 depicts an enlarged perspective view of the car door interlock of FIG. 1.
Figure 3:
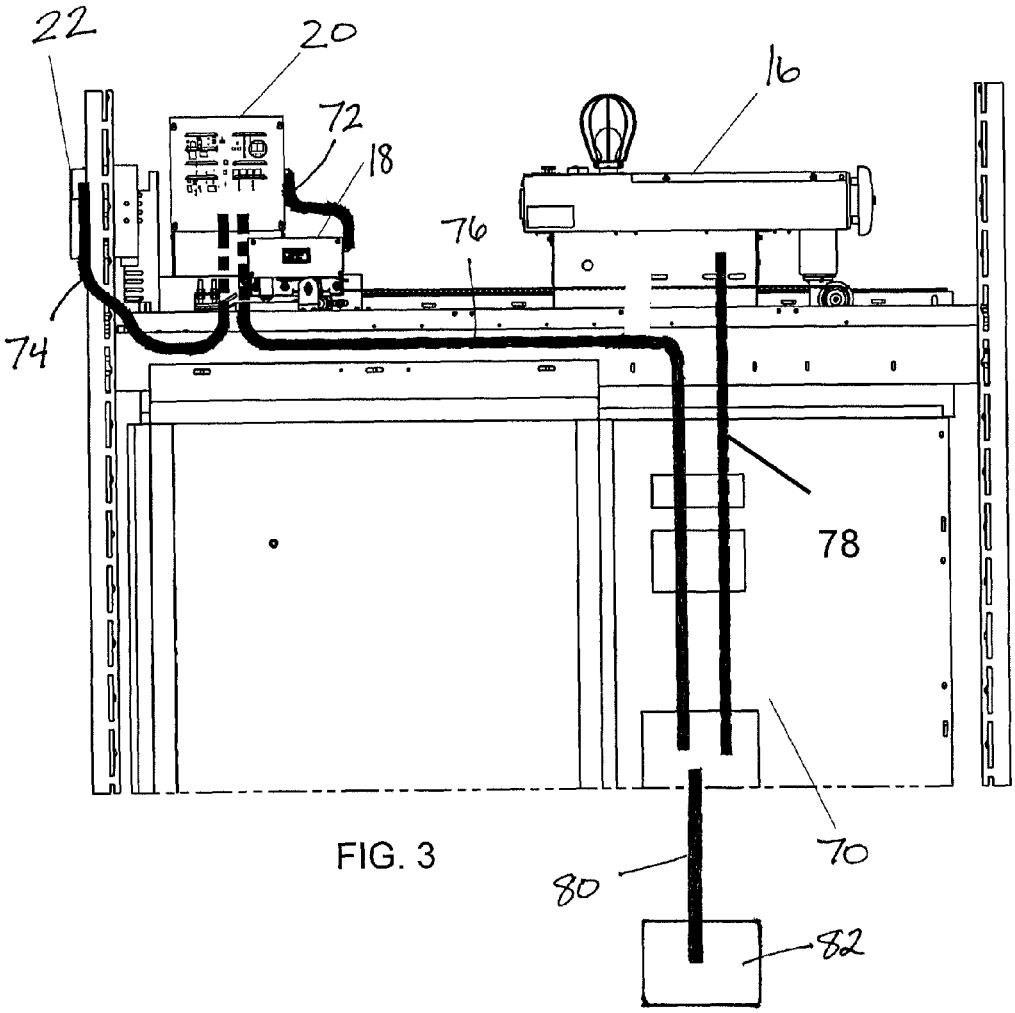
FIG. 3 depicts a partial front view of the elevator car of FIG. 1.

FIGS. 2 and 3 illustrate car door interlock (12), which comprises interlock assembly (18), control box (20), and unlock zone assembly (22). In one version, interlock assembly (18) and control box (20) are mounted to a car header (64), which may be mounted at the top of elevator car door (14). In other versions, interlock assembly (18), control box (20), and unlock zone assembly (22) are attached directly to the top of elevator car door (14) without the use of car header (64). In other versions, interlock assembly (18), control box (20), and unlock zone assembly (22) are mounted at separate locations from each other, or are mounted near each other at a location other than the top of elevator car door (14), such as, for example, near the bottom of elevator car door (14), inside elevator car door (14), at a remote location from elevator car door (14), or at any other suitable location which will be apparent to those of ordinary skill in the art in view of the teachings herein.

Interlock assembly (18) and unlock zone assembly (22) are connected with control box (20) by wire harness (72) and wire harness (74) respectively. Control box (20) is connected with car operating panel (70) of elevator car (10) by wire harness (76). Door operator (16) is connected with car operating panel (70) by wire harness (78). Car operating panel (70) is connected with elevator controller (82) by wire harness (80). Thus control box (20) and door operator (16) are in communication with elevator controller (82) via car operating panel (70). In some versions, interlock assembly (18) and unlock zone assembly (22) are in communication with elevator controller (82) via control box (20) and car operating panel (70). In other versions any suitable communication connection scheme between the components can be used. By way of example only, in some versions redundant communication connections are used, e.g., where interlock assembly (18) and unlock zone assembly (20) are connected with car operating panel (70) directly in addition to indirectly via control box (20). Still in other versions various components in addition to car operating panel (70) can be directly connected to elevator controller (82).

Wire harnesses (72, 74, 76, 78, 80) allow for communications to be transmitted and received between components. In other versions, such communications between components can be accomplished by other means. By way of example only, a wireless communication system can be used. Still other communication means will be apparent to those of ordinary skill in the art based on the teachings herein.

In the present example, car operating panel (70) is accessible to a passenger and is operable to receive a variety of instructions from a passenger. Still in other versions, car operating panel (70) is shielded from access by a passenger. In the present example, the instructions from the passenger are relayed to other components. For example, in some instances car operating panel (70) sends instructions to elevator controller (82) specifying a particular floor to which the passenger wishes to travel. In some instances, car operating panel (70) sends instructions to door operator (16) requesting that elevator car door (14) remain open. In some instances, car operating panel (70) sends instructions to door operator (16) requesting that elevator car door (14) be closed. In the present example, car operating panel (70) is configured to interface with control box (20) of car door interlock (18) regarding actions requested by the passenger as these actions relate to control of elevator car door (14). For instance, where a passenger request would require elevator car door (14) to be locked or unlocked, control box (20) determines if certain conditions are met such that the passenger's request can be accommodated. If such conditions are met, then control box (20) communicates with interlock assembly (18) to lock or unlock elevator car door (14). In some versions, the information received at car operating panel (70) regarding a passenger request that impacts the operation of elevator car door (14) is relayed directly to elevator controller (82), and elevator controller (82) determines if certain conditions are met such that the passenger's request can be accommodated. In such versions, if such conditions are met, then elevator controller (82) communicates with control box (20), which further communicates with interlock assembly (18) to lock or unlock elevator car door (14). By way of example only, in some versions the conditions considered for locking and unlocking elevator car door (14) comprise: first, whether or not elevator car (10) is moving, and second, whether or not elevator car is located at a designated landing zone. The conditions would be considered met in this example when the elevator car (10) was not moving and was located at a designated landing zone.

Figure 4:
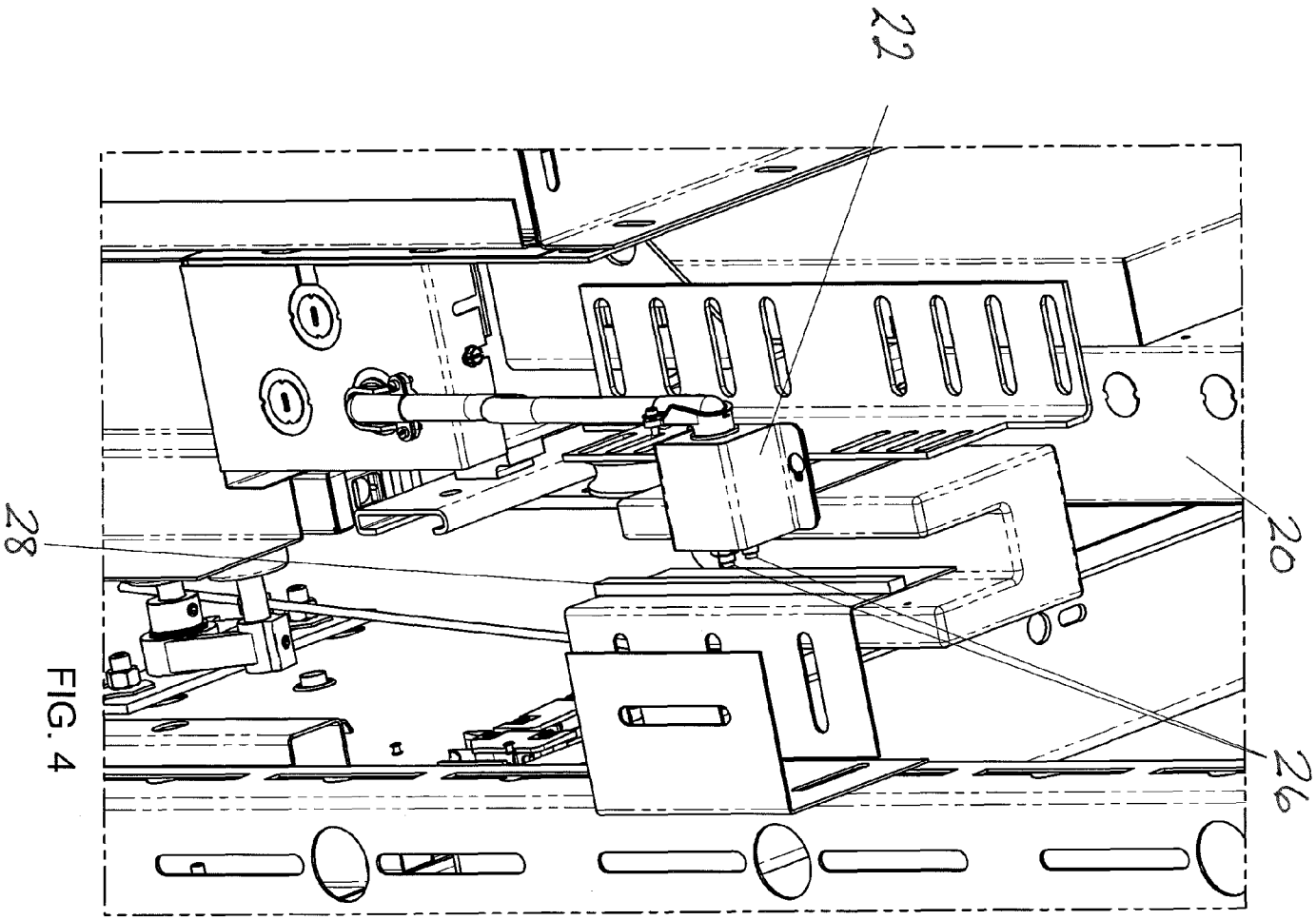
FIG. 4 depicts a partial perspective view of the car door interlock of FIG. 1, showing an exemplary unlock zone assembly.

FIG. 4 illustrates unlock zone assembly (22) of car door interlock (12). Unlock zone assembly (22) is mounted on elevator car (10). In some versions, unlock zone assembly is configured to be mounted on a bracket of elevator car (10) that is attached to a header of door operator (16). Unlock zone assembly (22) reads an element within hoistway (2) as elevator car (10) travels within hoistway (2). In some versions the element is located on a bracket attached to a header of each floor in hoistway (2). Unlock zone assembly (22) is configured to detect the position of elevator car (10) based at least in part on proximity to the associated element. The detection of this position information provides information related to whether or not elevator car (10) is positioned at a designated landing zone. Unlock zone assembly (22) communicates position information to control box (20).

In the illustrated version, unlock zone assembly (22) comprises one or more landing zone sensors (26). Landing zone sensors (26) are operable to detect when elevator car (10) is positioned at a designated landing zone within hoistway (2). In one version, landing zone sensors (26) comprise two Reed switches, of course other suitable sensors as would be apparent to one of ordinary skill in the art in view of the teachings herein can be used. In the illustrated version, one or more landing zone magnets (28) are positioned within hoistway (2) at or near designated landing zones and landing zone sensors (26) are capable of detecting landing zone magnets (28). In one version, landing zone magnets (28) are positioned on a leveling vane such that when landing zone sensors (26) and landing zone magnets (28) are aligned, elevator car (10) is positioned properly within a landing zone. Any suitable number of landing zone sensors (26) and any suitable number of landing zone magnets (28) can be used. In other versions, detection schemes other than, or in addition to, magnetic sensors and magnets can be used to detect landing zones. By way of example only, in some other versions optical sensors can be used to identify certain markings that can be located at the landing zones. Still other detection schemes for identifying landing zones will be apparent to those of ordinary skill in the art based on the teachings herein. Once unlock zone assembly (22) establishes that elevator car (10) is in a landing zone and communicates that elevator car (10) is located in a landing zone to control box (20), then control box (20) communicates to interlock assembly (18) indicating that interlock assembly (18) can unlock elevator car door (14) to allow elevator car door (14) to open, assuming that other required conditions are met (e.g., elevator car (10) is not moving). In some versions, one or more programmable interface controllers (PICs) can be configured to monitor each of landing zone sensors (26) to ensure proper operation of car door interlock (12).

FIGS. 5-9 illustrate interlock assembly (18). Interlock assembly (18) comprises assembly housing (24), sensor board (38), solenoid (46), lock pin (48), gate switch top contact arm (50), gate switch bottom contact arm (52), door closed sensor (58), and door partially opened sensor (56).

Assembly housing (24) can be constructed of plastic, metal, a metal-alloy, or any other suitable material. Assembly housing (24) can be integrally formed or may be constructed by securing separately formed pieces with glue, screws, bolts, etc. A portion of assembly housing (24) is removably attached so as to allow a user to open assembly housing (24) to access components contained inside, or in the alternative, assembly housing (24) may be hermetically sealed. Assembly housing (24) may be removably attached to car header (64) atop elevator car door (14).

Figure 10:
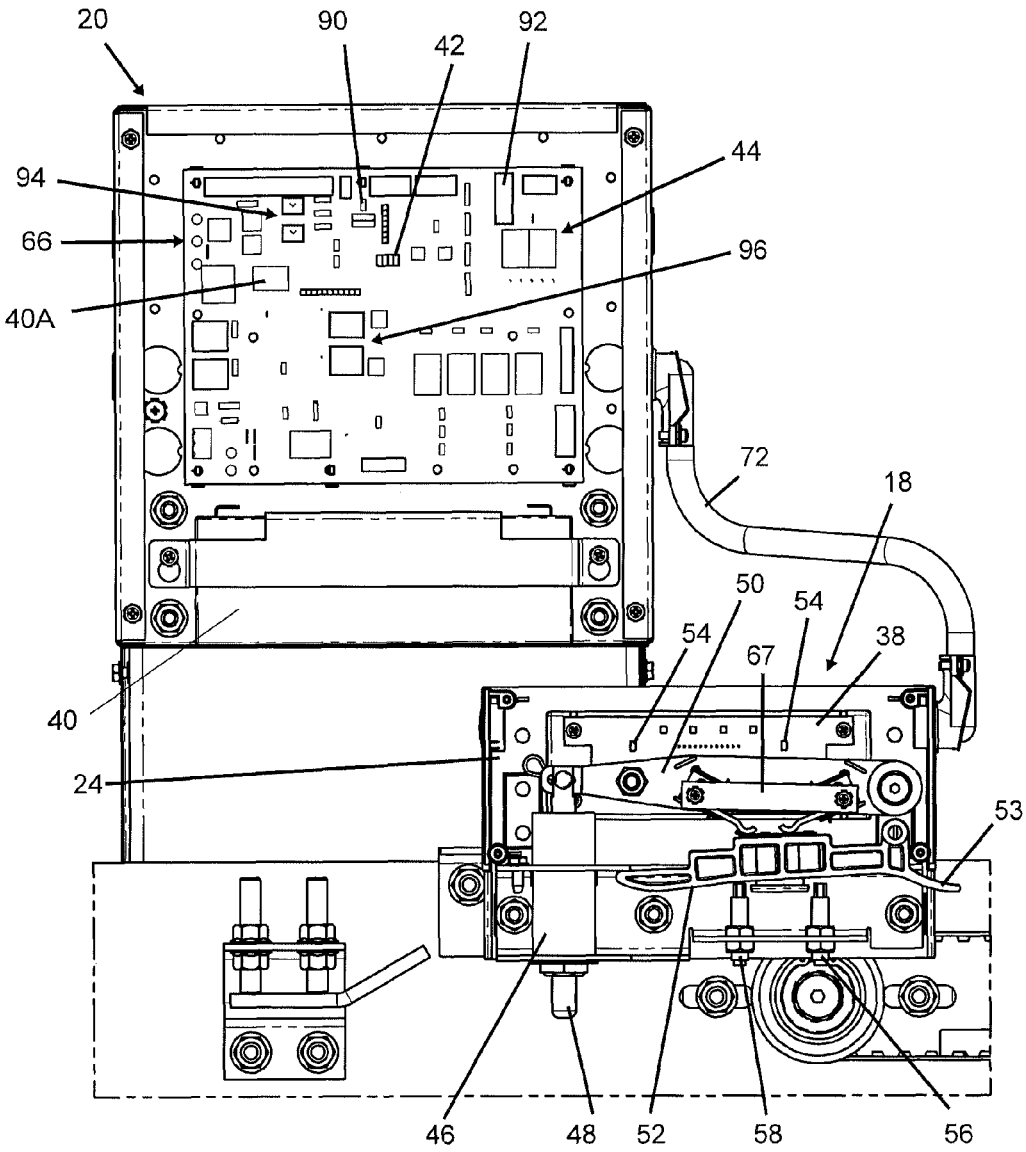
FIG. 10 depicts a front view of the interior of the car door interlock in FIG. 1, showing the interlock assembly and an exemplary control box.

Sensor board (38) is contained inside assembly housing (24) and is removably attached to assembly housing (24). Sensor board (38) is in communication with solenoid up sensor (54) and solenoid down sensor (60). Sensor board is in communication with door closed sensor (58) and door partially opened sensor (56). Door closed sensor (58) is configured to detect whether elevator car door (14) is in a closed position. Door partially opened sensor (56) is configured to detect if elevator car door (14) is opened approximately 2-4 inches, but may be configured to detect a variable range or any suitable range of opening positions for elevator car door (14). Solenoid up sensor (54) is configured to determine if lock pin (48) is in a retracted position and solenoid down sensor (60) is configured to detect whether lock pin (48) is in an extended position in relation to solenoid (46). Each of solenoid up sensor (54), solenoid down sensor (60), door closed sensor (58), and door partially opened sensor (56) can comprise different sensors such as, for example, a magnetic or an optical sensor. While in the present example multiple sensors are used to detect parameters, in some other versions, a single sensor can be configured to detect multiple parameters and perform substantially the same functions of solenoid up sensor (54), solenoid down sensor (60), door closed sensor (58), and door partially opened sensor (56). As shown in FIG. 10, sensor board (38) is in communication with a control board (66) contained in control box (20) which has a visual indicator (44), which may be, for example, an LED to indicate if each of solenoid up sensor (54), solenoid down sensor (60), door closed sensor (58), and door partially opened sensor (56) are properly functioning.

Referring again to FIGS. 5-9, solenoid (46) is positioned generally inside assembly housing (24). Solenoid (46) is seated abutting the outer wall of assembly housing (24) such that a portion of solenoid (46) extends through assembly housing (24). In the illustrated version, solenoid (46) is pointed in the direction of elevator car door (14) so as to allow lock pin (48) to engage car header (64) as shown in FIG. 6. In the present example, car header (64) is connected with elevator car door (14) and includes opening (65) configured to receive lock pin (48) when lock pin (48) is extended from solenoid (46). This engagement between lock pin (48) and opening (65) locks elevator car door (14) in the closed position. While in the present example lock pin (48) engages car header (64), in other versions, lock pin (48) engages other structures connected with elevator car door (14) to accomplish locking and unlocking elevator car door (14).

Solenoid (46) comprises a bi-stable solenoid operable to be energized to lift/unlock lock pin (48) or energized to drop/extend lock pin (48). Solenoid (46) comprises a generally cylindrical or rectangular shape and is in communication with lock pin (48). Lock pin (48) is positioned within solenoid (46) or is positioned close enough such that a magnetic field produced by solenoid (46) is operable to control the movement of lock pin (48). A magnetic field is produced by a pair of adjustably controllable field effect transistors (FETs) for coils of each solenoid (46). The two field effect transistors per coil of each solenoid (46) may be used to control the magnetic field produced by solenoid (46). However, any suitable number of FETs may be used to control the magnetic field produced by solenoid (46).

Solenoid (46) is configured to actuate lock pin (48) in first and second directions thereby moving lock pin (48) to either a retracted position or an extended position. Lock pin (48) is generally cylindrical in shape, but may be any suitable shape so as to prevent the opening of elevator car door (14) once lock pin (48) engages car header (64). In an extended position, lock pin (48) engages car header (64) to form a lock, thus preventing elevator car door (14) from opening. In a retracted position, lock pin (48) is configured to retract into solenoid (46) and no longer engage car header (64), thus allowing elevator car door (14) to slide from a closed position to an open position or from an open position to a closed position.

Figure 8:
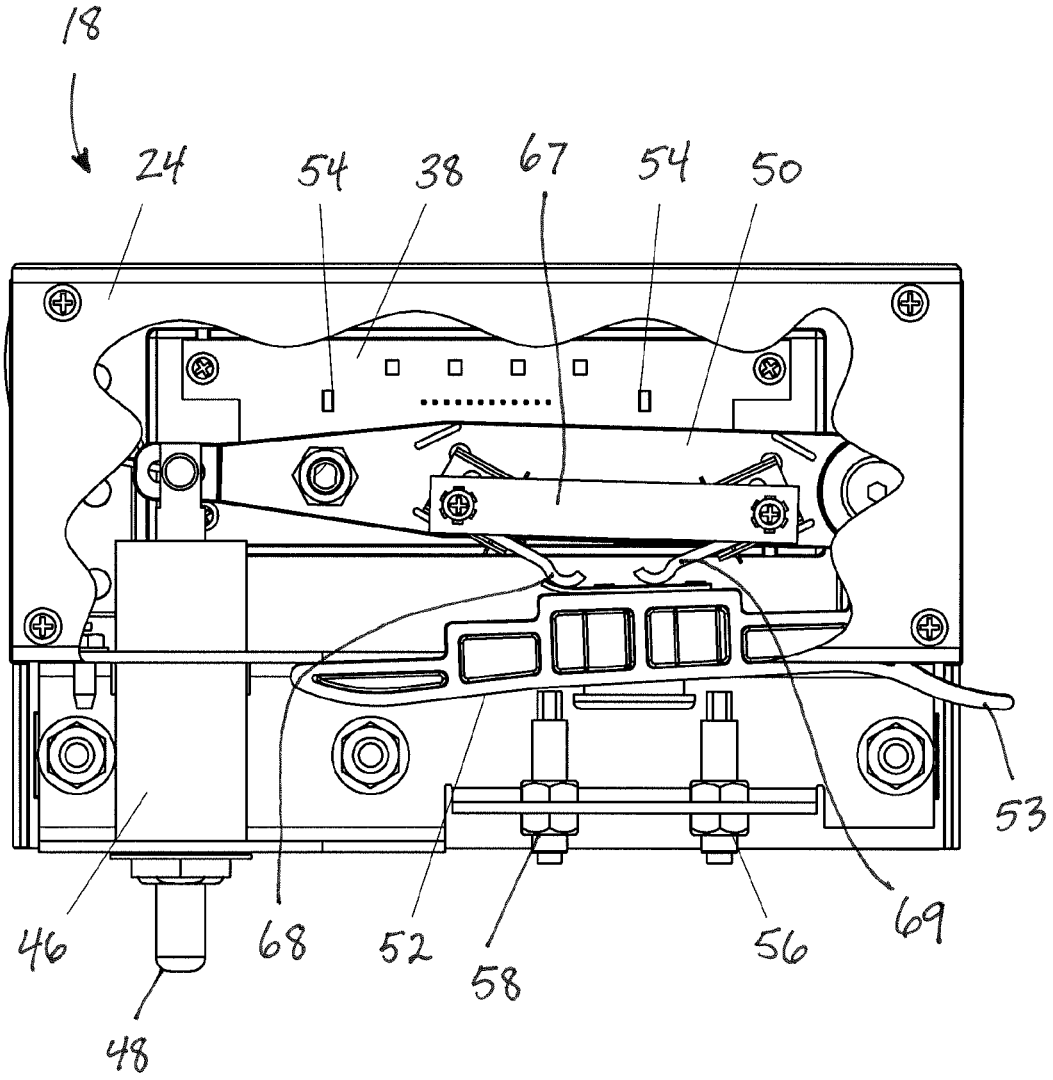
FIG. 8 depicts a front view of the interior of an exemplary interlock assembly of the car door interlock of FIG. 1, shown in the locked position.
Figure 9:
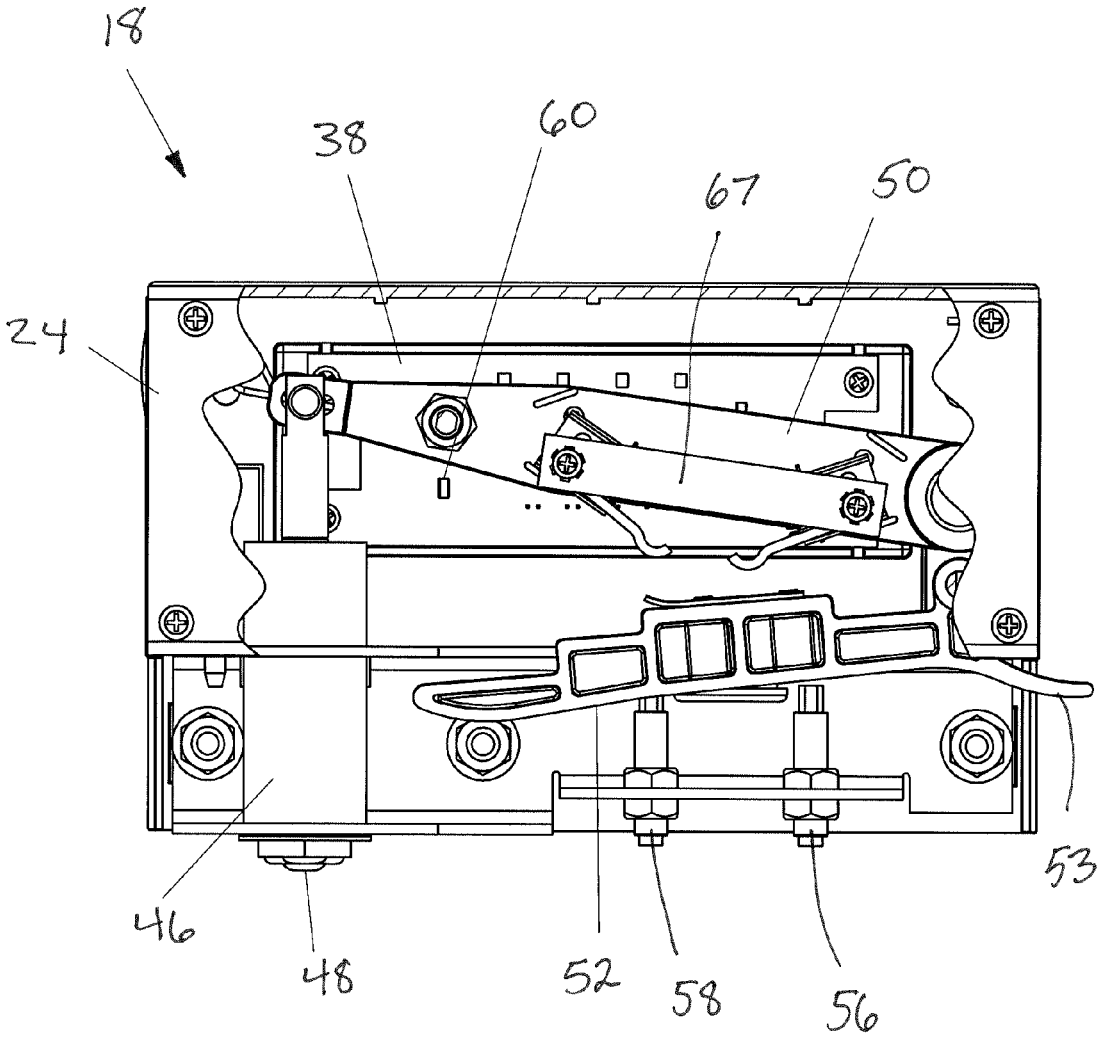
FIG. 9 depicts a front view of the interior of the interlock assembly of the car door interlock of FIG. 1, shown in the unlocked position.

In the illustrated version, gate switch top contact arm (50) is positioned in assembly housing (24). Gate switch top contact arm (50) comprises a cantilevered arm removably attached to assembly housing (24) at a hinge but any suitable means of attachment may be used. Further, gate switch top contact arm (50) is in communication with solenoid (46) and is in further communication with solenoid up sensor (54) and solenoid down sensor (60) on sensor board (38). Gate switch top contact arm (50) has an open position as shown in FIG. 9, and a closed position as shown in FIGS. 8 and 10. When solenoid (46) is actuated such that lock pin (48) is in extended position to lock elevator car door (14), solenoid (46) pulls cantilevered arm of gate switch top contact arm (50) downward thereby switching gate switch top contact arm (50) to closed position as shown in FIG. 8. With gate switch top contact arm (50) in the closed position, solenoid down sensor (60) detects gate switch top contact arm (50) signaling that lock pin (48) is extended. When lock pin (48) moves from an extended position to a retracted position to unlock elevator car door (14), solenoid (46) actuates cantilevered arm of gate switch top contact arm (50) upward, which then switches gate switch top contact arm (50) to an opened position as shown in FIG. 9. With gate switch top contact arm (50) in the open position, solenoid up sensor (54) detects gate switch top contact arm (50) signaling that lock pin (48) is retracted.

In the illustrated version, gate switch bottom contact arm (52) is positioned in assembly housing (24) and positioned below gate switch top contact arm (50). Gate switch bottom contact arm (52) is configured to have an open position as shown in FIG. 9, and a closed position as shown in FIGS. 8 and 10. Gate switch bottom contact arm (52) comprises a cantilevered arm removably attached to assembly housing (24) at a hinge, but any suitable means of connection may be used. Gate switch bottom contact arm (52) will be described in greater detail below when discussing interlock roller (32).

In the illustrated version, door closed sensor (58) and door partially opened sensor (56) comprise two magnetic sensors, but any suitable number, type, or configuration of sensors may be used. Door closed sensor (58) and door partially opened sensor (56) are positioned parallel to the path of movement of elevator car door (14) such that door closed sensor (58) and door partially opened sensor (56), in conjunction, are able to determine whether elevator car door (14) is fully closed or partially opened by detecting door position magnets (36), which are located on car header (64) and move with elevator car door (14) as it opens and closes. For instance, if elevator car door (14) is fully closed, then door closed sensor (58) will be triggered; if elevator car door (14) is partially opened, then only door partially opened sensor (56) will be triggered or neither door closed sensor (58) nor door partially opened sensor (56) will be triggered. Once door closed sensor (58) detects that elevator car door (14) is closed, door closed sensor (58) communicates to solenoid (46) to extend lock pin (48), thus locking elevator car door (14). In one version, in the event that either door closed sensor (58) or door partially closed sensor (56) malfunctions, elevator car (10) is signaled to advance to the next landing zone and halt.

Figure 5:
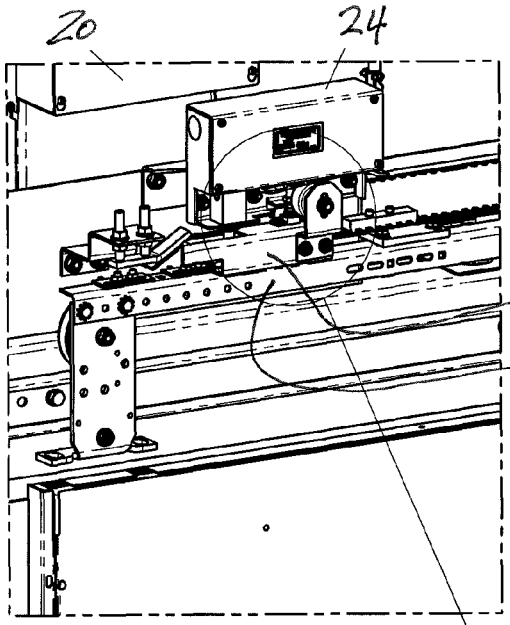
FIG. 5 depicts a partial perspective view of the car door interlock of FIG. 1, showing the elevator car door closed and the car door interlock in a locked position.
Figure 6:
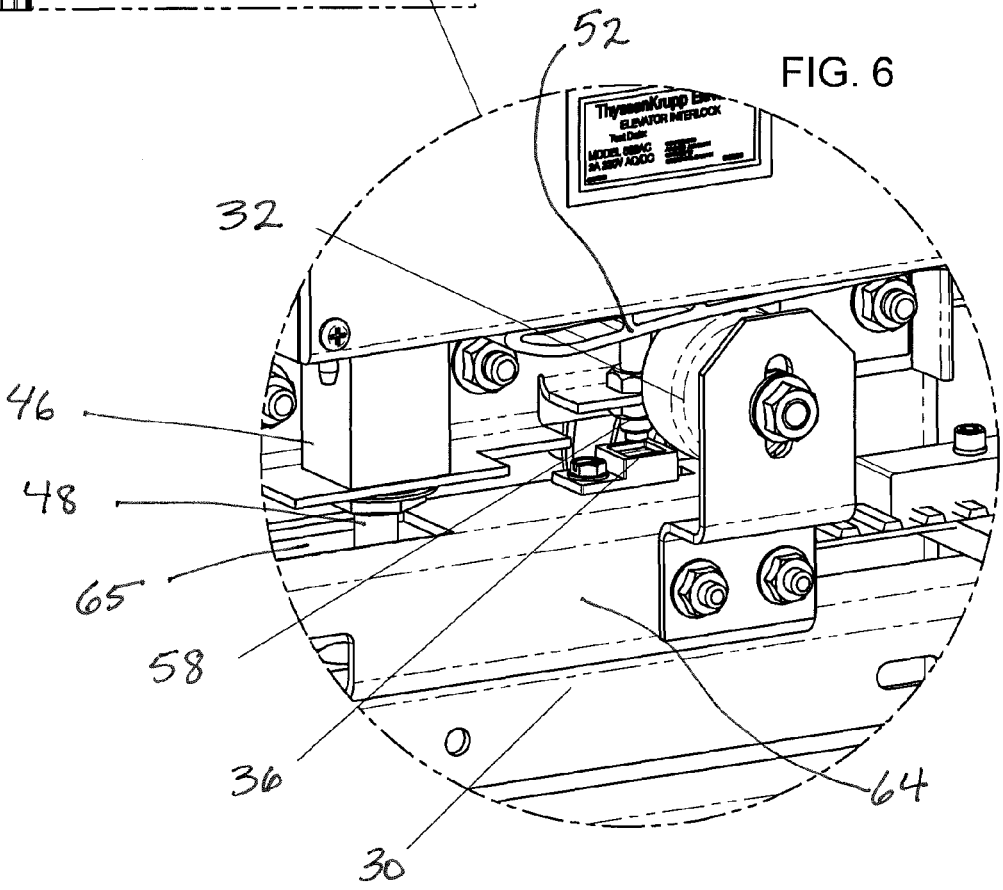
FIG. 6 depicts an enlarged perspective view of a portion of the car door interlock of FIG. 5.
Figure 7:
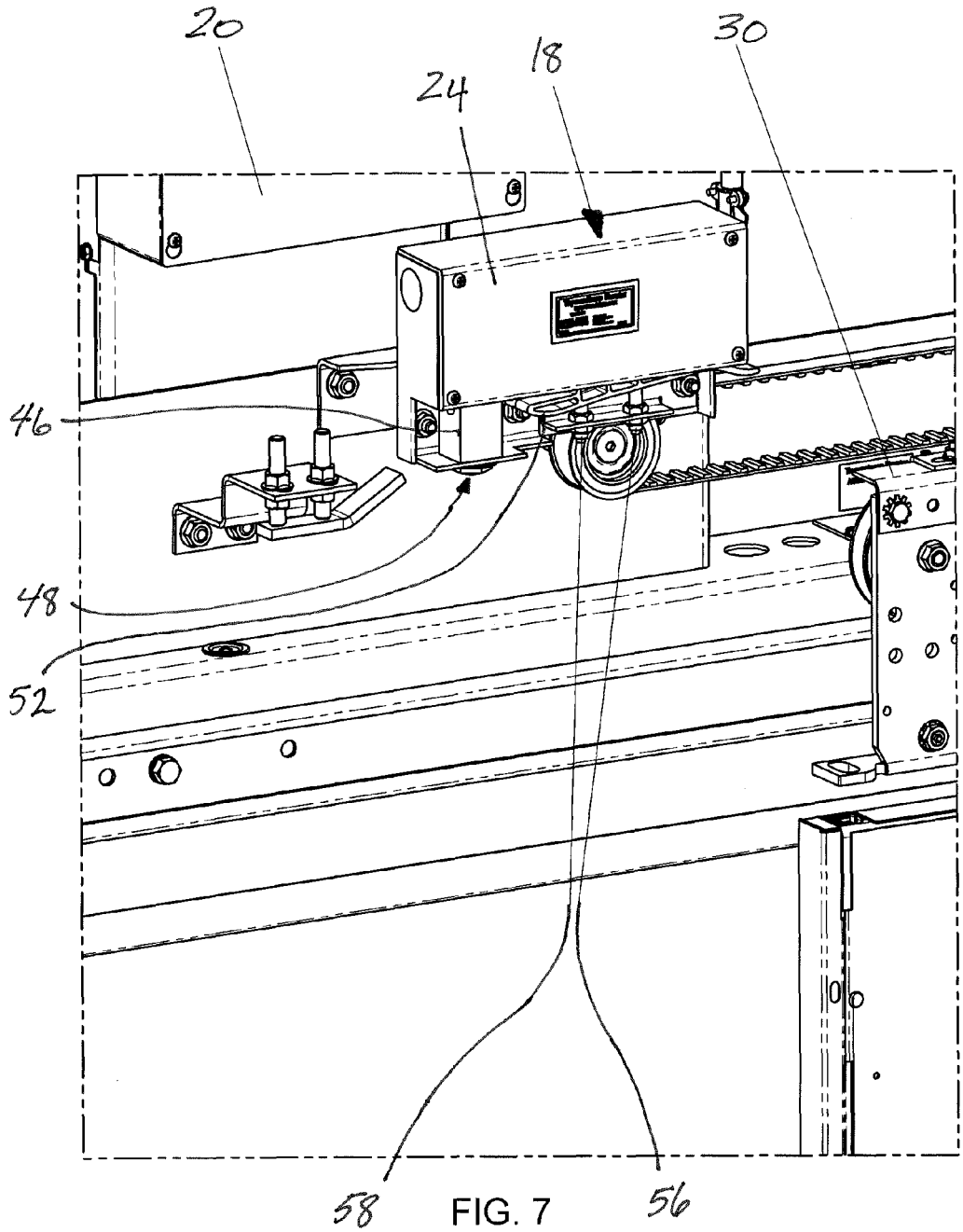
FIG. 7 depicts a partial perspective view of the car door interlock of FIG. 1, showing the elevator car door open and the car door interlock in an unlocked position.

Referring to FIGS. 5 and 6, interlock roller (32) is attached to car header (64) by a bracket. Since car header (64) moves with elevator door (14) as it opens and closes, interlock roller (32) also move with elevator door (14). Interlock roller (32) is arranged such that when it moves with elevator door (14), it is positioned underneath gate switch bottom contact arm (52). As mentioned above, door position magnets (36) are also attached to car header (64) and positioned such that door position magnets (36) can slidably pass underneath door closed sensor (58) and door partially opened sensor (56) to actuate door closed sensor (58) and door partially opened sensor (56). Car header (64) is in communication with hanger (30), which enables car header (64) to move back and forth with elevator car door (14) as elevator car door (14) opens and closes.

Interlock roller (32) and gate switch bottom contact arm (52) are positioned such that interlock roller (32) exerts an upward force on gate switch bottom contact arm (52) as elevator car door (14) moves from an open to a closed position. When elevator car door (14) is fully closed, the upward force of interlock roller (32) on gate switch bottom contact arm (52) actuates the cantilevered gate switch bottom contact arm (52) to shift it upward to a closed position. When elevator car door (14) is partially open, the upward force of interlock roller (32) on gate switch bottom contact arm (52) actuates gate switch bottom contact arm (52) upward part way to a partially opened position. When elevator car door (14) opens such that neither door closed sensor (58) nor door partially opened sensor (56) are triggered, interlock roller (32) no longer exerts an upward force on gate switch bottom contact arm (52) such that gate switch bottom contact arm (52) moves to an open position. In the present example, gate switch contact arm (52) includes downward extending fin (53) that contacts interlock roller (32) when elevator car door (14) is sufficiently open such that neither door closed sensor (58) nor door partially opened sensor (56) detect door position magnets (36). When interlock roller (32) contacts fin (53), gate switch contact arm (52) pivots upward at the fin (53) side and downward at the opposite side thus moving gate switch contact arm (52) to the open position. While the present example shows fin (53) on gate switch contact arm (52), fin (53) is not required and in other versions gate contact arm (52) is biased to the open position such that without upward force of interlock roller (32) gate switch contact arm (52) will assume an open position. Thus, depending on whether elevator car door (14) is closed, partially open, or open, gate switch bottom contact arm (52) will be actuated differently.

In the illustrated version, gate switch top contact arm (50) and gate switch bottom contact arm (52) are in communication through gate switch (67), which comprises first contact unit (68) and a second contact unit (69). When gate switch top contact arm (50) and gate switch bottom contact arm (52) are both in a closed position, as shown in FIGS. 8 and 10, gate switch (67) is closed with first contact unit (68) and second contact unit (69) contacting gate switch bottom contact arm (52). When gate switch top contact arm (50) and gate switch bottom contact arm (52) are both in an open position, then gate switch (67) is open without first contact unit (68) and second contact unit (69) contacting gate switch bottom contact arm (52). Whether gate switch (67) is in open position or closed position is then communicated to elevator controller (82), either directly or via control box (20) by communication from sensor board (38) to control board (66). In the present example, gate switch (67) being open means that elevator car door (14) is unlocked or not fully closed, thus elevator car (10) will not move. But if gate switch (67) is closed, that means that elevator car door is locked and fully closed, thus elevator car (10) is permitted to move.

FIG. 10 illustrates a front internal view of interlock assembly (18) along with control box (20). Control box (20) comprises control board (66), communications unit (90), at least one programmable interface controller (PIC) (96), battery (40), and diagnostic unit (92). As mentioned above, control box (20) can be connected to elevator controller (82) directly (e.g., by a wire harness), indirectly via another component (e.g., by a wire harness connection to car operating panel (70) that is further connected to elevator controller (82)), or both directly and indirectly. Communications unit (90) enables control box (20) to communicate with the elevator controller (82) via the direct and/or indirect connection. In the present example, communications unit (90) is configured as a Controller-Area Network (CAN), but can be configured as an RS485, and configured to enable serial and discrete communication to the elevator controller (82).

By communicating with elevator controller (82), control box (20) can signal to elevator controller (82) to direct elevator car (10) as to whether it is safe to move up or down through hoistway (2) based on the status of elevator car door (14) and car door interlock (12). In addition or in the alternative, control box (20) can signal to elevator controller (82) to direct elevator car (10) to remain at its current position in hoistway (2). For instance, if both gate switch bottom contact arm (52) and gate switch top contact arm (50) are in a closed position, meaning that elevator car door (14) is closed and lock pin (48) is engaged, thus meaning that elevator car door (14) is locked, then control box (20) signals to elevator controller (82) to allow elevator car (10) to move from its current position toward the next destination floor. However, if either or both gate switch top contact arm (50) and/or gate switch bottom contact arm (52) are open, then control box (20) signals to elevator controller (82) to direct elevator car (10) to remain at its current position and prevent elevator car (10) from moving.

In some versions, control board (66) includes at least one jumper (42) for determining whether elevator car door (14) is at the front of elevator car (10) or at the back of elevator car (10). Jumper (42) may be configured at the installation of control box (20) or at any suitable time thereafter. At least one jumper (42) may have different configurations for the front door and the back door so as to distinguish between the front door and back door of elevator car (10). For example, a first position for at least one jumper (42) signifies that car door interlock (12) is associated with a front door of elevator car (10), whereas a second position for at least one jumper (42) signifies that car door interlock (12) is associated with a back door of elevator car (10). Front and back door information can be associated with information corresponding to gate switch top contact arm (50) or gate switch bottom contact arm (52). Other suitable methods of communication with elevator controller (82) will be apparent to one of ordinary skill in the art in view of the teachings herein.

The PICs (96) associated with control box (20) are used to monitor various components of car door interlock (12), including, but not limited to, each of the sensors in car door interlock (12), power levels for power supply (40A), state of solenoid (46), FETs, etc. Any suitable number of PICs (96) can be used.

In the present example, power supply (40A) of control box (20) is configured to deliver about at least 24 VDC and about 3 amps power to car door interlock (12). However, in other versions a greater or lesser amount of power or current can be used. Power supply (40A) can deliver power in a variety of ways including, but not limited to, direct delivery through electrical wire, a rechargeable battery pack, a fuel cell, one or more solar cells, inductive power, or any other suitable method.

Power supply (40A) in conjunction with battery (40) can be in communication with at least one PICs (96) and configured to provide at least 4 hours of backup power. Power supply (40A) can further be configured to be a 12V onboard charger monitored by at least one PICs (96). Each PIC (96) in communication with power supply (40A) may be configured to monitor condition, wear level, and/or power level of battery (40). In the event that an external power source fails to provide sufficient power for any portion of car door interlock (12), such condition of power failure can be detected by PICs (96), and PICs (96) can correspondingly automatically execute commands to switch to using battery (40) to supply power to car door interlock (12).

Control board (66) may further comprise two discrete fault relays (94). Fault relays (94) may be configured to trigger or drop out if supply VDC falls below about 22 VDC and are capable of switching 24 VDC or 115 VAC 250 milliamps. Fault relays (94) may be further configured to be controlled or monitored by at least one PICs (96). Alternatively, any suitable number of fault relays (94) may be used.

Diagnostic unit (92) of control box (20) is configured to diagnose potential issues regarding car door interlock (12). Diagnostic unit (92) is operable by user to initiate a particular diagnostic reading, or to initiate a diagnostic mode configured to collect and analyze various diagnostic readings. Diagnostic readings can be read from power supply (40A), PICs (96), FETs, or other portions of car door interlock (12). Diagnostic readings can be compared to a series of normal readings or otherwise established standard reading or measurement. In the event that one of the diagnostic readings is abnormal, or is not in accordance with an expected reading, control box (20) communicates the diagnostic reading to a user by way of visual indicator (44). In the present example, visual indicator (44) comprises at least one diagnostic LED and two 5"×7" dot matrix displays. The at least one diagnostic LED and dot matrix displays are configured to display fault codes corresponding to abnormal or erroneous diagnostic readings. Visual indicator (44) need not be limited to a single LED or two dot matrix displays. Any number of LEDs or dot matrix displays can be used. Alternatively, any other suitable visual or audio indicators can be used as would be apparent to one of ordinary skill in the art in view of the teachings herein.

Figure 11:
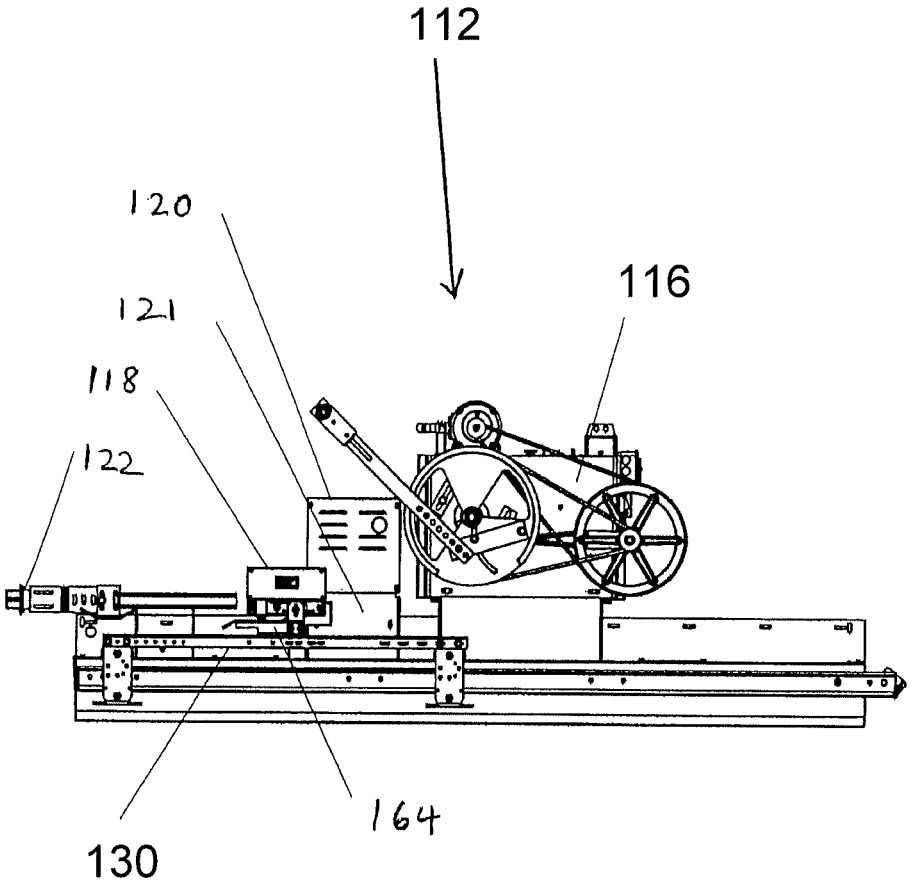
FIG. 11 depicts a partial front view of another exemplary car door interlock.
Figure 12:
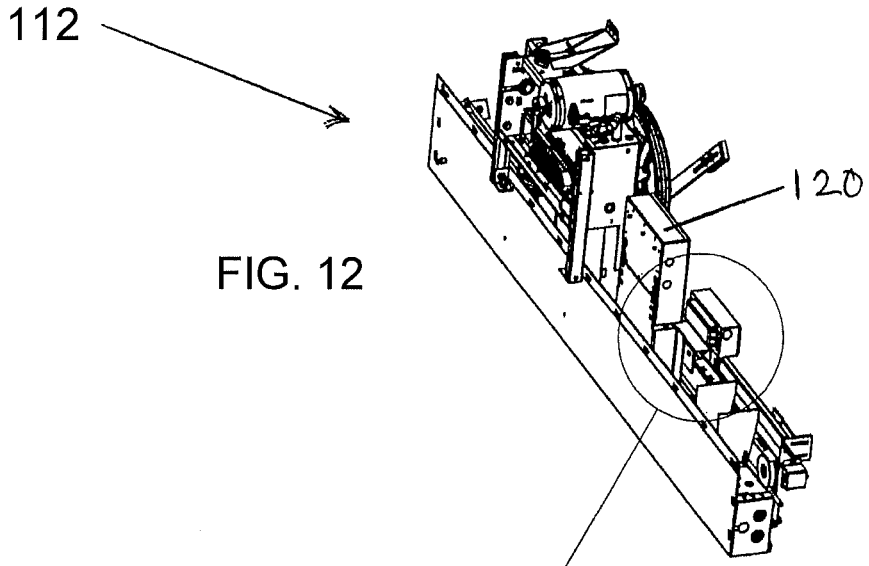
FIG. 12 depicts a perspective view of the car door interlock of FIG. 11.
Figure 13:
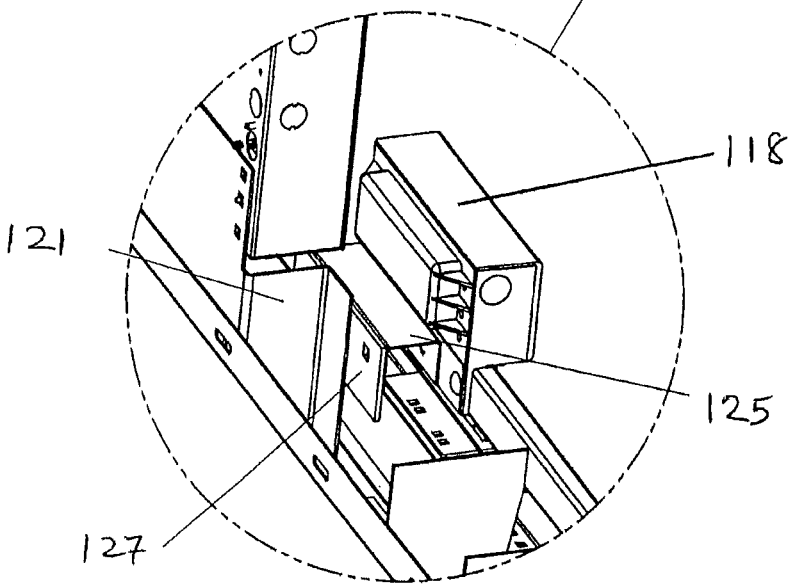
FIG. 13 depicts an enlarged perspective view of a portion of the car door interlock of FIG. 12.

FIGS. 11-13 illustrate an alternative car door interlock (112) for use with an harmonic door operator (116). An interlock assembly (118) is attached to car header (164). Car header (164) is in communication with hanger (130). Control box (120) sits atop of a main box support (121). Door operator (116) is operable to open and close one or more elevator car doors. In the present example unlock zone assembly (122) determines if the elevator car is positioned at a landing zone. As seen in FIG. 13, interlock assembly (118) is in communication with main box support (121) via mounting bracket (125). Generally speaking, it will be appreciated that car door interlock (112) operates substantially similar to car door interlock (12) described above with reference to FIGS. 1-10. Therefore further description of car door interlock (112) and its operation is not repeated here.

In operation, elevator car (10) moves from floor to floor with elevator car door (14) held closed by car door interlock (12). Elevator car door (14) is configured to open only when elevator car (10) is at a landing zone or an otherwise appropriate area within hoistway (2). Elevator car door (14) is also configured to open only when elevator car (10) is stopped. In one version, the position of elevator car (10) in front of a hoistway door is detected by unlock zone assembly (22) as described above. Thus an exemplary operating sequence for elevator car (10) comprises: elevator car (10) moving to a floor to pick up passengers and stopping within a landing zone as will be determined by unlock zone assembly (22); car door interlock (12) unlocking and door operator (16) opening elevator car door (14) allowing passengers to board; door operator (16) closing and car door interlock (12) locking elevator car door (14) after passengers board and a destination floor request is received; car door interlock (12) signaling to elevator controller (82) that elevator car door (14) is closed and locked; elevator controller (82) directing elevator car (10) to proceed to the destination floor; elevator car (10) moving to the destination floor and stopping within a landing zone as will be determined by unlock zone assembly (22); car door interlock (12) unlocking and door operator (16) opening elevator car door (14) allowing passengers to depart or board elevator car (10). In such an exemplary operation, if car door interlock (12) determines that elevator car (10) is not in an appropriate position via unlock zone assembly (22) within hoistway (2), car door interlock (12) is configured to remain locked to prevent the opening of elevator car door (14). As a result, passengers will not be able to exit elevator car (10) when it is unsafe to do so as a result of the position of elevator car (10) within hoistway (2).

Car door interlock (12) can be configured to work with a variety of elevator types such as, but not limited to, destination dispatch elevators, double-decker elevators, hospital emergency elevators, express elevators, front and rear entrance elevators, or other suitable elevator types as will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. An apparatus for an elevator car to lock and unlock an elevator car door, the apparatus comprising:

(a) an interlock selectively connectable with the elevator car door, the interlock comprising:

(i) a locking member configured to selectively prevent the elevator car door from opening by moving between a disengaged position and an engaged position, (ii) a first and second sensor, wherein the first sensor is configured to detect whether the elevator car door is closed, wherein the second sensor is configured to detect whether the locking member is in the engaged position, (iii) a first and second arm, each having an open position and a closed position, wherein the first arm is in the closed position when the elevator car door is closed, wherein the second arm is in the closed position when the locking member is in the engaged position, (iv) a gate switch mounted on the second arm, wherein the switch is configured to contact the first arm when the first and second arms are in the closed position verifying the first sensor and position of the elevator as closed, and further verifying the second sensor and position of the locking member as in the engaged position; and (b) a control device in electrical communication with the interlock, the control device in further electrical communication with an elevator controller, wherein the control device communicates a signal to the interlock to prevent the elevator car door from opening unless the elevator car has stopped at a designated landing zone, wherein the switch being in contact with the first arm causes the control device to signal to the elevator controller to allow movement of the elevator car.

2. The apparatus of claim 1, further comprising a plurality of elevator car sensors configured to detect when the elevator car is positioned at the designated landing zone.

3. The apparatus of claim 2, wherein the plurality of elevator car sensors are operable to function independently from each other.

4. The apparatus of claim 2, wherein the plurality of sensors are further configured to be magnetic sensors.

5. The apparatus of claim 1, wherein the locking member comprises a solenoid and a lock pin, wherein the solenoid is configured to actuate the lock pin.

6. The apparatus of claim 5, wherein the solenoid is configured to actuate the lock pin to permit the elevator car door to open only when the elevator car is not traveling through a hoistway and the elevator car is positioned at a landing zone.

7. The apparatus of claim 1, further comprising a portable power supply operable to power the interlock and the control device.

8. The apparatus of claim 1, further comprising an actuator configured to contact the first arm when the elevator door is closed, wherein the contact with the arm causes the first sensor to signal to the control device that the elevator car door is closed.

9. An interlock apparatus for an elevator car to lock and unlock an elevator car door, the interlock apparatus comprising:

a locking member having a disengaged position and an engaged position, wherein the locking member in the engaged position is configured to prevent the elevator car door from opening;

a first sensor configured to detect whether the elevator car door is in an opened position or closed position;

a first arm having an open position and a closed position, wherein the first arm is in the closed position when the first sensor detects that the elevator car door is in the closed position;

a second sensor configured to detect whether the locking member is in the disengaged or the engaged position by detecting the position of a second arm coupled to the locking member, the second arm having an opened position and a closed position, wherein the second arm is in the closed position when the second sensor detects that the locking member is in the engaged position; and a gate switch mounted on the second arm, wherein the switch is configured to contact the first arm when the first and second arms are in the closed position verifying both the first sensor and position of the elevator car door as in the closed position, and the second sensor and position of the locking member as in the engaged position.

10. The apparatus of claim 9 further comprising a power supply configured to power the interlock.

11. The apparatus of claim 10, wherein the power supply comprises a primary supply and a backup supply, wherein the backup supply is configured to automatically provide power to the interlock if the primary supply is unable to provide power.

12. The apparatus of claim 9, wherein the locking member comprises a solenoid configured to actuate a lock pin, wherein the lock pin is configured to interface with an engagement portion of the elevator car door.

13. The apparatus of claim 9, wherein the first sensor is a magnetic sensor.

14. The apparatus of claim 9 further comprising an elevator controller, wherein the elevator controller is configured to receive information from the interlock apparatus comprising the position of a select one or both of the first arm and the second arm.

15. The apparatus of claim 9, further comprising an elevator controller configured to prevent the elevator car from traveling through a hoistway unless the first arm and the second arm are in closed positions.

16. The apparatus of claim 9, further comprising at least one position sensor configured to detect the position of the elevator car in a hoistway.

17. The apparatus of claim 9, further comprising a control device, wherein the control device communicates a signal to the interlock apparatus to prevent the elevator car door from opening unless the elevator car has stopped at a designated position in a hoistway.

* * * * *